US006863566B2

(12) United States Patent
Scheuerer

(10) Patent No.: US 6,863,566 B2
(45) Date of Patent: Mar. 8, 2005

(54) SUBASSEMBLY WITH A PLUG-IN HOUSING CONNECTOR

(75) Inventor: Ulf Scheuerer, Hagelstadt (DE)

(73) Assignee: Siemens Aktiengesellschaft, Munich (DE)

( * ) Notice: Subject to any disclaimer, the term of this patent is extended or adjusted under 35 U.S.C. 154(b) by 123 days.

(21) Appl. No.: 10/343,079

(22) PCT Filed: Jun. 27, 2001

(86) PCT No.: PCT/DE01/02372

§ 371 (c)(1),
(2), (4) Date: Jan. 27, 2003

(87) PCT Pub. No.: WO02/09240

PCT Pub. Date: Jan. 31, 2002

(65) Prior Publication Data

US 2004/0102101 A1 May 27, 2004

(30) Foreign Application Priority Data

Jul. 25, 2000 (DE) ..... 100 36 138

(51) Int. Cl.[7] ..... H01R 13/40

(52) U.S. Cl. ..... 439/587; 439/247; 439/34; 439/382; 439/191; 439/854

(58) Field of Search ..... 439/247–248, 439/587, 34, 382–384, 191–192, 854–855

(56) References Cited

U.S. PATENT DOCUMENTS

| | | | | | |
|---|---|---|---|---|---|
| 4,492,421 | A | * | 1/1985 | Ito | 439/271 |
| 4,609,239 | A | * | 9/1986 | Abel et al. | 439/194 |
| 6,033,247 | A | * | 3/2000 | Gregory, II | 439/248 |
| 6,062,888 | A | * | 5/2000 | Takiguchi | 439/248 |
| 6,224,421 | B1 | * | 5/2001 | Maturo, Jr. | 439/581 |
| 6,290,523 | B1 | * | 9/2001 | Barnhart et al. | 439/248 |
| 6,325,652 | B1 | * | 12/2001 | Grant | 439/248 |
| 6,439,909 | B1 | * | 8/2002 | Polgar et al. | 439/248 |

* cited by examiner

*Primary Examiner*—Truc Nguyen
(74) *Attorney, Agent, or Firm*—Cohen, Pontani, Lieberman & Pavane

(57) ABSTRACT

A subassembly for installing in a housing (2) comprises a supporting plate (4) on which a plug-in connector (5) is mounted as a separate part. Said plug-in connector (5) extends through a connector opening in the housing. A base section (5*a*) of the plug-in connector (5) is introduced into a receptacle of the supporting plate (13), which allows for the movement play of the plug-in connector (5) in the plane of the supporting plate (4) that is required for installation.

10 Claims, 3 Drawing Sheets

SUBASSEMBLY WITH A PLUG-IN HOUSING CONNECTOR

This is a national stage of PCT application No. PCT/DE01/02372, filed on Jun. 27, 2001. Priority is claimed on that application and on the following application(s): Country: Germany, Application No.: 100 36 138.2, Filed: Jul. 25, 2000.

BACKGROUND OF THE INVENTION

1. Field of the Invention

The invention relates to a subassembly for installation in a housing, in particular the transmission or engine housing, of a motor vehicle, for establishing a flexible, fluid-(e.g., oil) tight connection for elements such as electrical leads, between the interior and exterior of the housing. The subassembly includes a supporting plate and a plug-in connector designed as a separate part and mounted on the supporting plate, the plug-in connector being intended for protruding through a connector opening in the housing in the installed state.

2. Description of the Related Art

Previously, electronic controllers located in the passenger compartment of a motor vehicle were used for engine and transmission control purposes. There is currently a trend toward integration of the control electronics and the associated sensor technology in the corresponding subassembly (i.e. engine or transmission). The advantages of such fully integrated engine or transmission control are increased reliability and lower costs.

To lead electrical signals out of the transmission or engine housing to the outside, oil-tight plug-in connectors are used. To ensure that the plug-in corrector can be mounted and sealed in a connector opening in the housing, suitable measures must be taken to compensate for installation tolerances in order to make the connector flexible. The plug-in connector in the installed state has to meet demanding requirements in terms of vibration resistance and long-term leak-tightness under difficult ambient conditions (vibrations up to about 33 g, temperature variation in the range from −40° to 140° C., and use of ATF oil as the ambient medium).

A plug-in transmission connector on which the contact pins in the base region are mounted on a leadframe carried in the supporting plate is already known. By suitable design of the leadframe and the provision of tiltable articulation of the connector base on the supporting body, the connector can be flexibly aligned within a specific tolerance range. The difficulties of this solution are the relatively great space requirement (a certain minimum distance must be maintained between the supporting plate and the housing) and the risk of material fatigue occurring in the region of the connections between the contact pins and the leadframe.

Another known possibility is to provide a rigid connection between the plug-in connector and the supporting body and to achieve the required tolerance compensation by a thick sealing O-ring, which is pushed onto the plug-in connector. This solution is not suitable to compensate for large tolerances and, moreover, does not allow optimum mechanical relief of the plug-in connector in the transitional region with respect to the supporting plate.

European patent application EP 0 908 974 A2 discloses a plug-in transmission connector which is mounted on the supporting plate by means of an intermediate element. The intermediate element has a sliding rail, in which the plug-in transmission connector is displaceable in a given direction parallel to the supporting plate. However, the displaceability of the plug-in transmission connector does not allow tolerance compensation, since the displacement takes place coaxially with respect to the axis of the connector opening.

SUMMARY OF THE INVENTION

The object of the present invention is to provide a subassembly of the type stated above, which makes it possible to make the plug-in connector flexible with respect to the supporting plate, and to do so at low cost. In particular, the structural design provided for this purpose is intended to have a low space requirement.

The object on which the invention is based is achieved by providing a subassembly that includes a supporting plate and a separate plug-in connector mounted on the supporting plate, such that the plug-in connector protrudes through a connector opening in the housing, when the plug-in connector is in an installed state on the housing, and wherein a longitudinal axis of the plug-in connector is coaxial with an axis of the connector opening in the housing, and substantially perpendicular to a plane of the supporting plate; and a base section of the plug-in connector is inserted in a receptacle of the supporting plate to enable flexible movement of the plug-in connector within the plane of the supporting plate.

The provision of a receptacle in the supporting plate, in which a base section of the plug-in connector is inserted with lateral play, achieves the effect that the plug-in connector can be aligned with respect to the connector opening entirely free from any loads during the installation of the subassembly in the housing. The gap width between an outer circumference of the base section of the plug-in connector and the inner circumference of the receptacle may in this case be dimensioned in such a way that no bending stresses occur on the plug-in connector, even when there arc large installation tolerances.

Preferably provided as a further measure is a damping ring, which is arranged on the plug-in connector in the installed state between a resting surface on the base section of the plug-in connector and the housing, and which is forced into place. The damping ring aligns the plug-in connector with the plug-in opening during installation of the subassembly and fixes it in the installed position.

A preferred configuration of the subassembly according to the invention is characterized in that, at the height of the supporting plate surface facing the connector opening, engagement sections of a complementary form are provided on the receptacle and connector base. The engagement sections on the connector base and on the supporting plate form resting surfaces for the damping ring. In addition, rotational securement of the plug-in connector in the supporting plate is realized by the engagement sections. Should rotational stressing of the plug-in connector occur during the installation of the subassembly or during operation of the vehicle, the rotational securement ensures that the forces occurring are absorbed with minimal twisting of the plug-in connector and therefore do not act on the electrical leads (for example flexible printed circuit board).

In the case of a particularly low-cost embodiment of the invention, the plug-in connector is electrically contacted by means of a flexible printed circuit board mounted on the bottom of the plug-in connector base. The electrical printed circuit board may, in this case, be designed as an integral connecting element for the distribution of electrical signals in the entire transmission or engine.

According to a preferred embodiment of the invention, an integral section of the supporting plate is designed as a housing cover for an electrical control device, and the flexible printed circuit board extends on the underside of the supporting plate to the control device and electrically contacts the control electronics accommodated in the control device.

Further advantageous refinements of the invention are disclosed and described in the following.

BRIEF DESCRIPTION OF THE DRAWINGS

The invention is explained below on the basis of an exemplary embodiment with reference to the drawings, in which.

DETAILED DESCRIPTION OF THE PRESENTLY PREFERRED EMBODIMENT

Figure 1:
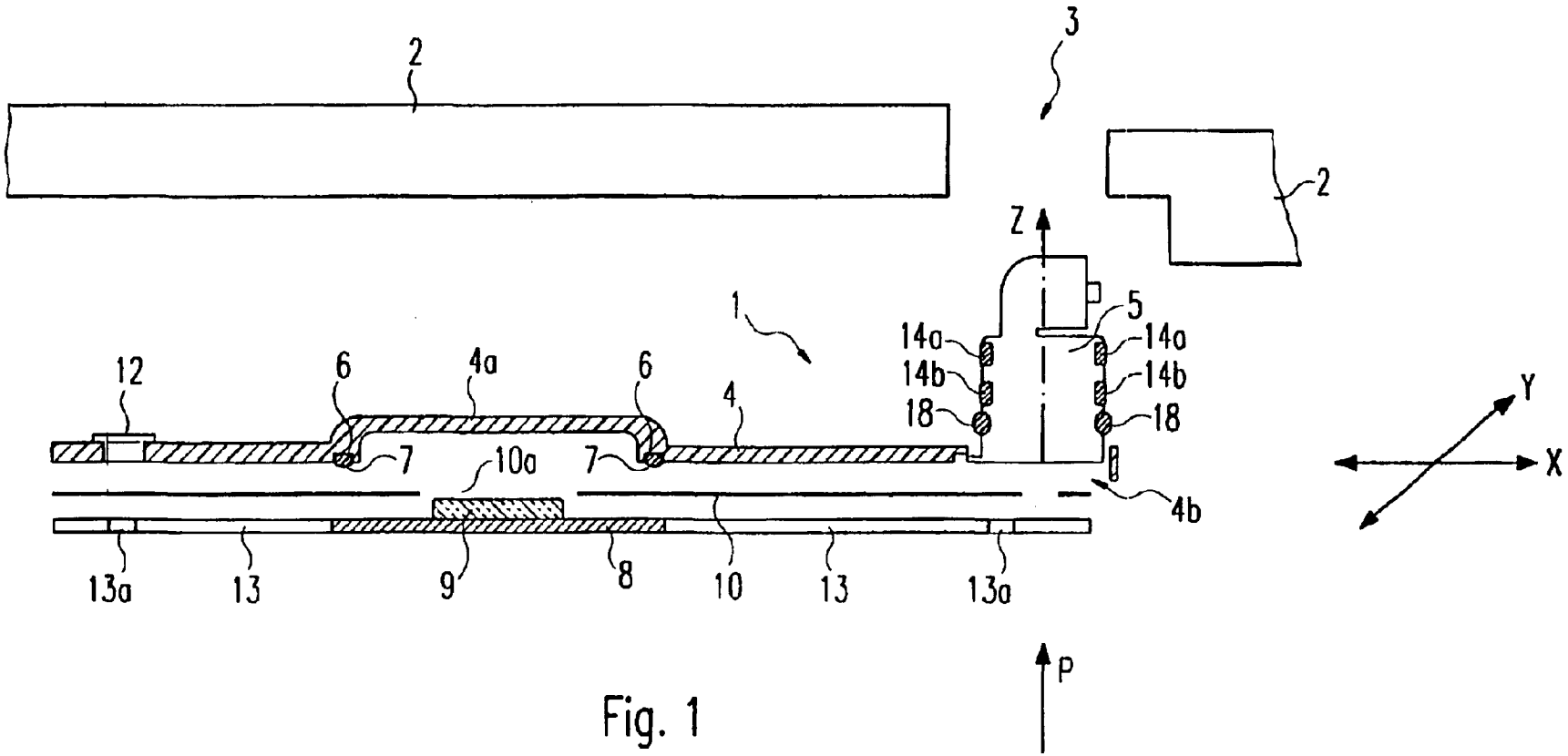
FIG. 1 is a schematic sectional representation of the subassembly according to the invention, which includes a supporting plate and plug-in connector mounted thereon and also further parts for installation in a transmission.

FIG. 1 shows an exemplary embodiment of a subassembly 1 according to the invention for installation in a motor vehicle transmission. A subsection of the transmission housing 2 with a connector opening 3 is seen in the upper part of FIG. 1. The subassembly 1 includes a plastic supporting plate 4 and a plug-in connector 5. In an integral section of the plastic supporting plate 4, a hood-shaped cover 4*a* for an electronic transmission control device is formed. The cover 4*a* has a peripheral sealing groove 6, which is made in the surface of the plastic supporting plate 4 facing away from the transmission housing 2. A form seal 7 is inserted into the peripheral sealing groove 6.

An aluminum plate 8 forms the base plate of the transmission control device. The aluminum plate 8 serves as a heat sink of an electronic circuit, which is implemented, for example, on a ceramic substrate 9 mounted on the aluminum plate 8.

The electrical contact of the electronic circuit takes place by means of a flexible printed circuit board 10. The flexible printed circuit board 10 has a central clearance 10*a*, through which the ceramic substrate 9 protrudes in the assembled state. The flexible printed circuit board 10 extends in the lateral direction to sensors and actuators, which are located outside the transmission control device and, if appropriate, may be mounted in the plastic supporting plate 4 (see, for example, temperature sensor designated by reference numeral 12). The flexible printed circuit board 10 extends further to the plug-in connector 5.

The assembly of the unit comprising the transmission control device and the plug-in connector 5 takes place as follows:

Firstly, the flexible printed circuit board 10 is laminated in an oil-tight manner onto the surface of the aluminum plate 8. After that, the ceramic substrate 9 with the electronic circuit is fastened on the aluminum plate 8 and electrically connected by bonding wires or other suitable contacting elements to the flexible printed circuit board 10.

In a further working step, the temperature sensor 12 is inserted into the plastic supporting plate 4 and the plug-in connector 5 is pushed from below (in the direction of the arrow P) into a receiving opening 4*b* of the plastic supporting plate 4, so that it is located in the position represented in FIG. 1. The plug-in connector 5 has a longitudinal axis Z, which runs substantially perpendicularly in relation to the plane XY of the supporting plate.

In a next step, the aluminum plate 8 is placed, with the electronic circuit mounted on it, together with the flexible printed circuit 10, onto the plastic supporting plate 4. An inner space of the transmission control device defined by the aluminum plate 8 and the cover 4*a* is sealed against oil penetration by the form seal 7. The flexible printed circuit board 10 is at the same time led through between the form seal 7 and the aluminum plate 8.

The aluminum plate 8 may be continued in the lateral direction by an optional flexible support element 13 adjoining flush with the aluminum plate 8. The flexible support element 13 serves for supporting, and prescribing a defined path of, the flexible printed circuit board 10 outside the aluminum plate 8. The flexible support element 13 also secures the plug-in connector 5 against falling out in the direction counter to the arrow P.

Following that, the temperature sensor 12 and the plug-in connector 5 are electrically connected to the flexible printed circuit board 10. Abutting contact is provided, for example, by means of a laser welding process. For this purpose, the flexible support element 13 has, at the corresponding points, apertures 13*a*, through which laser radiation can be directed onto the underside of the flexible printed circuit board.

After the contacting step, the entire assembly is inserted into the transmission as part of the installation of the transmission. Because of the construction of the subassembly according to the invention, as is explained in still more detail below, it is possible to compensate for installation tolerances by displacement of the plug-in connector 5 in the receiving opening 4*b* of the plastic supporting plate. In the installed state, the plastic supporting plate 4 and the wall 2 of the transmission housing in the region of the connector opening 3 run parallel to each other and the plug-in connector 5 protrudes through the connector opening 3. The sealing between the plug-in connector 5 and the connector opening 3 is achieved by two sealing rings 14*a*, 14*b* seated on the connector body.

Furthermore, mounted on the plug-in connector 5, in the region above the supporting plate 4, is a damping ring 18, which clamps the plug-in connector 5 with respect to the transmission housing after installation in the transmission. The damping ring 18 has the effect of fixing and positionally damping the plug-in connector 5 in the installed state.

Figure 2:
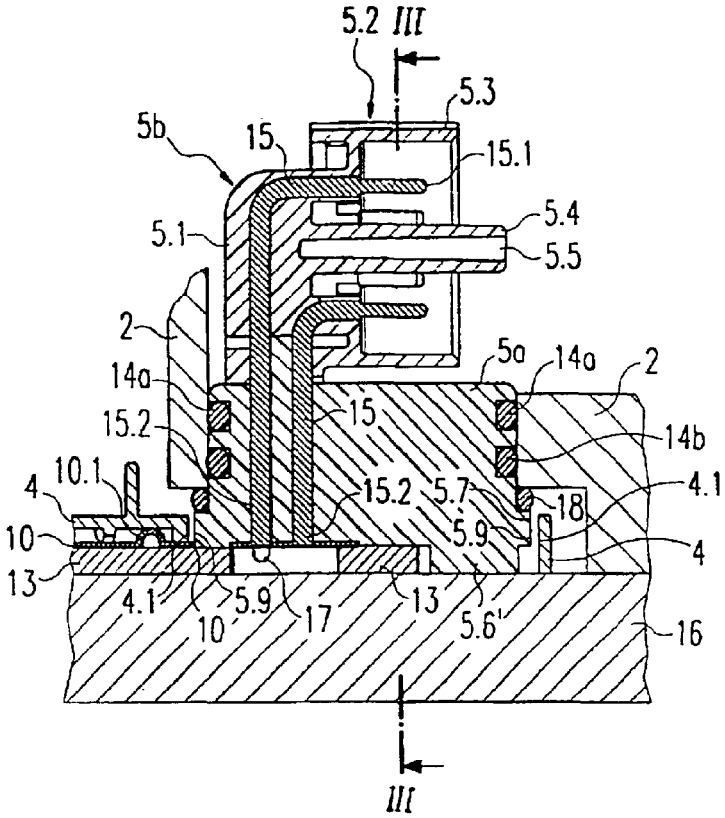
FIG. 2 is a schematic sectional representation of the supporting plate and plug-in connector in the installed state.

FIG. 2 shows a sectional representation of the plug-in connector 5 in the installed position. The plug-in connector 5, fabricated of plastic, includes a connector base 5*a* and a connector head 5*b*, attached to the connector base. The connector head 5*b* has, in the embodiment represented, a neck section 5.1 with a 90° bend and an adjoining plug-in section 5.2. The plug-in section 5.2 is formed by a cylindrical connector housing 5.3, in the center of which a central stub 5.4 protruding beyond the connector housing 5.3 is arranged, (see also FIG. 3). The central stub 5.4 is provided with a tapering centering channel 5.5, which interacts with a correspondingly arranged pin of a connector socket (not shown).

In an alternative embodiment, 5 may be configured on a single axis, i.e. without a 90° bend in the neck section 5.1.

In an alternative embodiment, the male plug-in section 5.2 may also be configured as a female socket, which interacts with an external male plug-in part (not shown in the drawings).

Connector base 5*a* and connector head 5*b* are passed through by electrical conductors 15. The electrical conductors are formed in the region of the connector housing 5.3, as protruding contact pins 15.1. With their other ends 15.2, the electrical conductors 15 lie freely on the bottom of the connector base 5*a* and are contacted there by conductor tracks of the flexible printed circuit board 10.

The attachment of the connector base 5*a* on the plastic supporting plate 4 is explained in more detail below with reference to FIGS. 2 and 3.

In the installed state, the entire assembly, comprising the flexible support plate 13, the flexible printed circuit board 10, and the subassembly according to the invention (plastic supporting plate 4 with plug-in connector 5) is located on a hydraulic control plate 16 of the transmission. The hydraulic control plate 16 runs parallel to, and at a small distance from, the wall 2 of the transmission housing.

The connector base 5*a* is supported by a partially-circular annular foot 5.6, which is provided with radial webs 5.6' (see also FIG. 5), on the hydraulic control plate 16. The remaining region of the bottom of the connector base is set back from the annular foot 5.6, so that in this region there is an intermediate space between the hydraulic control plate 16 and the bottom of the connector base 5*a*. The flexible support element 13, with the flexible printed circuit board 10 arranged on it are located in this intermediate space. The flexible printed circuit board 10 is not fixed on the flexible support element 13, at least in the vicinity of the contact points, with respect to the conductor ends 15.2, but is freely movable with respect to the flexible support element. Mechanical fixation of the flexible printed circuit board 10 takes place on the bottom of the conductor base 5*a* as a result of the abutting contacting with the conductor ends 15.2 (pins 17, which protrude through bores in the flexible printed circuit board 10 are provided for the tension relief of the contact points on the bottom of the connector) and at a location which is sufficiently distant from the connector 5 to ensure free displaceability of the flexible printed circuit board 10 in the region of the connector. In addition, a reserve of printed circuit board material can be provided in the form of a circuit board corrugation 10.1 for the purposes of tension relief.

The receiving opening 4*b* of the supporting plate 4 is dimensioned in such a way that there is a circumferentially continuous gap between the rim 4.1 of the opening and an outer circumference of the connector base 5*a* (in FIG. 2, a lower region 5.9 and a section 5.7, lying above it, of this outer circumference are seen). The gap width may be approximately between 0.5 mm and 2 mm, whereby a path of movement of 1 mm to 4 mm is realized in all directions of the XY plane.

Figure 3:
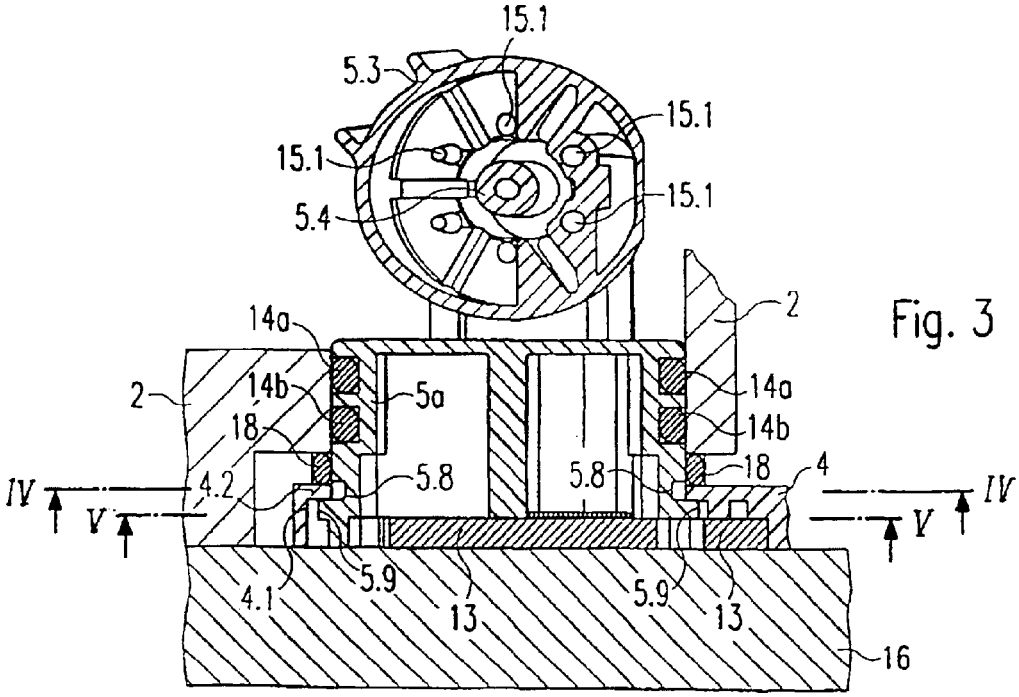
FIG. 3 is an oblique sectional view, cut along the line III—III, of the arrangement represented in FIG. 2.

As can be seen in FIG. 3, the outer circumference of the connector base 5*a* also has, in the upper subregion at the height of the section 5.7, circumferential depressions 5.8.

Figure 4:
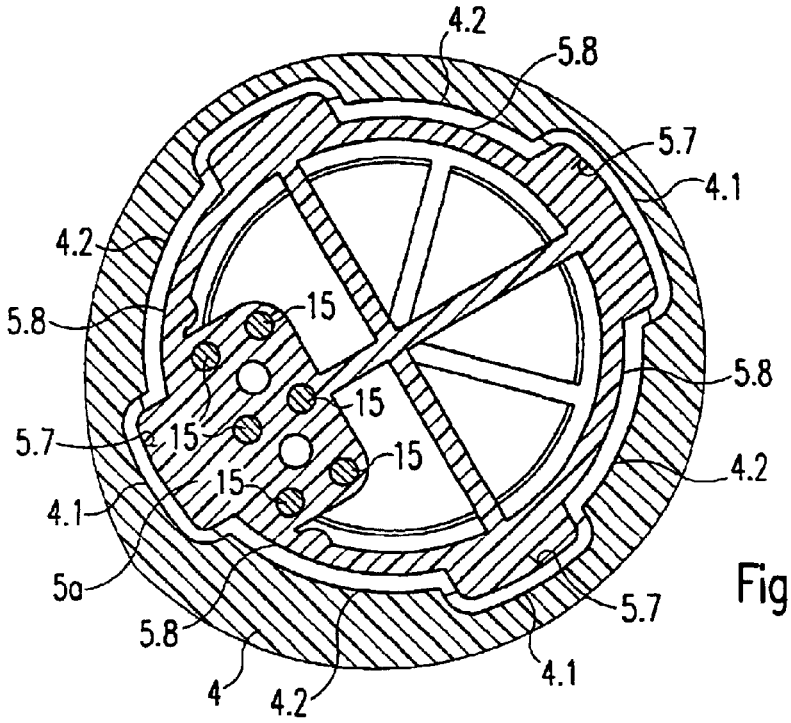
FIG. 4 is a schematic sectional representation along the line IV—IV in FIG. 3.

FIG. 4 shows a section through the connector base 5*a* and the plastic supporting plate 4 at the height of the circumferential section 5.7, and the circumferential depressions 5.8 along the line IV—IV in FIG. 3. Distributed over the circumference, four circumferential depressions 5.8 are provided. The circumferential segments remaining between the circumferential depressions 5.8 are bordered by the circumferential sections 5.7. Protruding into the circumferential depressions 5.8 are projections 4.2, of a complementary design, of the plastic supporting plate 4, which are implemented on corresponding sections at the rim of the receiving opening 4*b* (see also FIG. 3).

From FIGS. 2 and 3, in conjunction with FIG. 4, it is seen that the damping ring 18 rests in certain regions on the surfaces of the circumferential sections 5.7 and the surfaces of the projections 4.2 of the plastic supporting plate 4. Because of the contact pressure exerted by the damping ring 18 on both parts (connector base 5*a* and plastic supporting plate 4), a high mechanical positional stability of the plug-in connector 5 is achieved in the installed state.

The circumferential depressions 5.8 of the connector base 5*a* also form, together with the projections 4.2 of the supporting plate 4, a rotational securement. In order not to impair the free mobility of the plug-in connector 5 in the receiving opening 4*b* of the supporting plate 4, within the degree of tolerance during installation, the gap continues with a substantially constant gap width over the entire circumference between the sections 4.2 and 5.8 or 4.1 and 5.7, and in particular also in the region of the transitions between the aforesaid sections.

Figure 5:
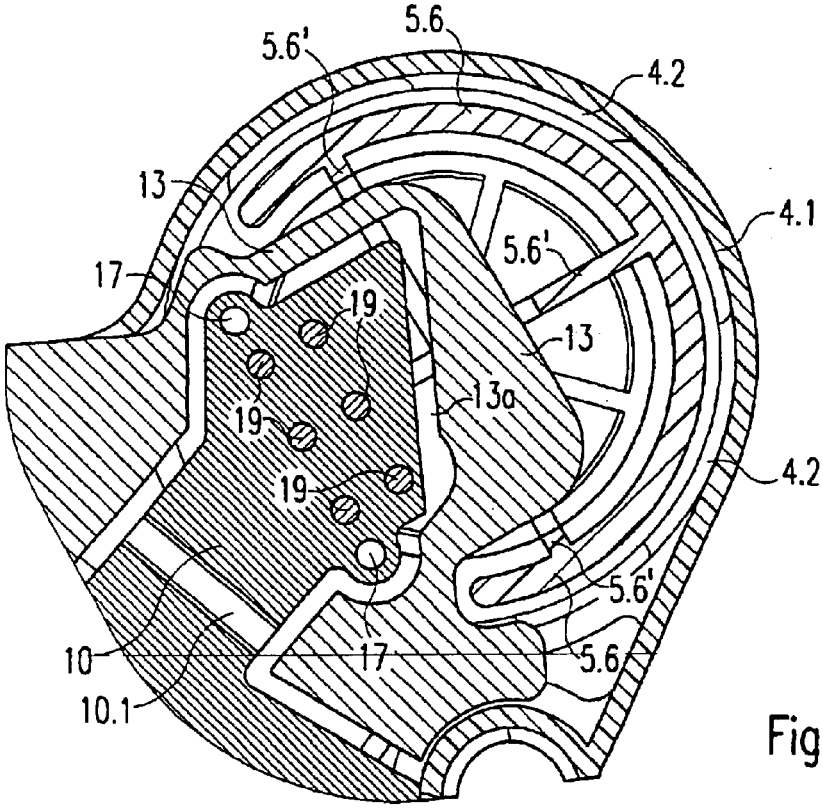
FIG. 5 is a schematic sectional representation along the line V—V in FIG. 3.

FIG. 5 shows a section through the subassembly according to the invention at the height of the flexible printed circuit board 10 along the line V—V in FIG. 3. Of the plastic supporting plate 4, the opening rim 4.1 can be seen; in the region of the connector base 5*a*, the section passes through the partially-circular annular foot 5.6 and through radial webs 5.6'. The two outer radial webs 5.6' are designed merely in the form of short stubs. The flexible support element 13 extends through the lateral opening of the part-circular annular foot 5.6, under the connector base 5*a*. As already described, the flexible support element 13 is provided in the region of the conductor ends 15.2 with a clearance 13*a*, through which the underside of the flexible printed circuit board 10 extends. Contact points 19 are arranged between the conductor ends 15.2 of the plug-in connector 5 and conductor tracks (not shown) of the flexible printed circuit board 10. They may be produced, for example, by a laser welding step. Furthermore, the pins 17 protrude through openings in the flexible printed circuit board 10.

From the foregoing exemplary embodiment, it is evident that the invention allows movement play of the plug-in connector 5 in the XY plane defined by the supporting plate 4 on all sides before and during the installation of the subassembly 1. At the same time, extremely small installation depths of approximately 1 cm can be realized between the surface of the hydraulic control plate 16 and the inner side of the housing wall 2, and nevertheless no bending stresses occur during the installation of the subassembly in the region of the coupling between the plastic supporting plate 4 and the plug-in connector 5.

What is claimed is:

1. A subassembly installable in a housing for establishing a flexible, fluid-tight connection between an interior and an exterior of the housing, the housing having a connector opening, said subassembly comprising:

a supporting plate;

a separate plug-in connector mounted on said supporting plate such that said plug-in connector protrudes through the connector opening in the housing when said plug-in connector is in an installed state on the housing, wherein a longitudinal axis of said plug-in connector is coaxial with an axis of the connector opening in the housing, and substantially perpendicular to a plane of said supporting plate, and a base section of said plug-in connector is inserted in a receptacle of said supporting plate such that said plug-in connector is flexibly movable in said plane of said supporting plate; and a damping ring, attached to said plug-in connector such that when said plug-in connector is in an installed state on the housing, said damping ring rests between a surface on said base section of said plug-in connector and the housing.

2. The subassembly according to claim 1, wherein a gap of substantially constant width is defined between an inner circumference of said receptacle and an outer circumference of said base section, as measured from respective mid-centers of said circumferences, when said base section is centered with respect to said receptacle.

3. The subassembly according to claim 1, wherein said receptacle and said base section further comprise complementary engagement sections thereon such that said engagement sections are distributed over respective circumferences of said receptacle and said base section.

4. The subassembly according to claim 1, further comprising a flexible printed circuit board attached to said base section of said plug-in connector on a bottom thereof, wherein an electrical contact for said plug-in connector is provided by said flexible printed circuit board.

5. The subassembly according to claim 2, wherein said gap has a width of from 0.5 mm to 2.0 mm.

6. The subassembly according to claim 3, wherein surfaces of said engagement sections on said receptacle and on said base section that face the connector opening provide resting surfaces for said damping ring.

7. The subassembly according to claim 4, further comprising an electrical control device, wherein an integral section of said supporting plate forms a housing cover for said electrical control device and said flexible printed circuit board extends on an underside of said supporting plate to said electrical control device, and is in electrical contact therewith.

8. A subassembly installable in a housing for establishing a flexible, fluid-tight connection between an interior and an exterior of the housing, the housing having a connector opening, said subassembly comprising:

a supporting plate;

a separate plug-in connector mounted on said supporting plate such that said plug-in connector protrudes through the connector opening in the housing when said plug-in connector is in an installed state on the housing, wherein a longitudinal axis of said plug-in connector is coaxial with an axis of the connector opening in the housing, and substantially perpendicular to a plane of said supporting plate, and a base section of said plug-in connector is inserted in a receptacle of said supporting plate such that said plug-in connector is flexibly movable in said plane of said supporting plate; and a flexible printed circuit board attached to said base section of said plug-in connector on a bottom thereof, wherein an electrical contact for said plug-in connector is provided by said flexible printed circuit board.

9. The subassembly according to claim 8, further comprising an electrical control device, wherein an integral section of said supporting plate forms a housing cover for said electrical control device and said flexible printed circuit board extends on an underside of said supporting plate to said electrical control device, and is in electrical contact therewith.

10. The subassembly according to claim 1, wherein the housing in which said subassembly is installable is one of a transmission of a motor vehicle and an engine housing of a motor vehicle.

* * * * *